United States Patent [19]

Barnoff et al.

[11] Patent Number: 4,604,841

[45] Date of Patent: Aug. 12, 1986

[54] CONTINUOUS, PRECAST, PRESTRESSED CONCRETE BRIDGE DECK PANEL FORMS, PRECAST PARAPETS, AND METHOD OF CONSTRUCTION

[76] Inventors: Robert M. Barnoff, 606 Nimitz Ave., State College, Pa. 16801; Gordon A. Nagle, P.O. Box 74, R.D. #1, Orwigsburg, Pa. 17961

[21] Appl. No.: 481,311

[22] Filed: Apr. 1, 1983

[51] Int. Cl.[4] ..... E01D 19/02

[52] U.S. Cl. ..... 52/174; 52/379; 52/223 R; 14/73; 14/17

[58] Field of Search ..... 52/174, 378, 379, 262, 52/223 R; 14/73, 17, 6; 404/6, 73

[56] References Cited

U.S. PATENT DOCUMENTS

| | | | |
|---|---|---|---|
| 2,863,206 | 12/1958 | Kirchner | 52/223 |
| 3,678,815 | 7/1972 | Younker | 14/73 |
| 3,872,635 | 3/1975 | Miram | 52/224 |
| 4,050,213 | 9/1977 | Dillon | 52/262 X |
| 4,282,619 | 8/1981 | Rooney | 14/73 X |
| 4,300,320 | 11/1981 | Rooney | 14/73 X |
| 4,348,133 | 9/1982 | Trent et al. | 404/6 |

FOREIGN PATENT DOCUMENTS 2139035 2/1973 Fed. Rep. of Germany .... 52/223 R

OTHER PUBLICATIONS

Engineering News Record 4/4/63, p. 79.

*Civil Engineering*, Apr. 1980, pp. 75–77, 52/174.

*Primary Examiner*—Henry E. Raduazo

*Attorney, Agent, or Firm*—Thomas E. Sterling

[57] ABSTRACT

This invention provides an improved and more efficient method and articles of manufacture to construct new bridge decks, or to replace existing bridge decks. This unique method of constructing deck slabs utilizes precast, prestressed concrete form panels that are continuous over the floor beams or supporting walls. A cast-in-place concrete topping is placed on the form panels and finished to the proper grade to become the top surface of the slab. The cast-in-place topping also bonds to the roughened top surface of the precast, prestressed form panels and acts with the panels to create a structural deck slab. In addition, this invention embodies a new method and article of manufacture and installation for precast parapets, safety curbs and traffic divisors which are attached to a precast, prestressed continuous panel positioned on the supporting beams, or a conventional bridge deck.

5 Claims, 8 Drawing Figures

CONTINUOUS, PRECAST, PRESTRESSED CONCRETE BRIDGE DECK PANEL FORMS, PRECAST PARAPETS, AND METHOD OF CONSTRUCTION

PRIOR ART STATEMENT

The inventors know of no uncited prior art anticipating this invention. The inventors are not withholding known prior art which they consider anticipates this invention.

This invention relates to the construction of new bridge decks and the replacement of deteriorated or damaged bridge decks. In particular this invention pertains to an improved and economical method for constructing new bridge decks or replacing decks on existing bridges. This deck system may also be used for any type structure where concrete deck slabs are used to support gravity loads and the deck is used to transfer the loads to beams, girders or walls.

PRIOR ART

There are many different methods used to construct concrete deck slabs. The most common are systems employing removable forms constructed with wood, steel, fiberglas or other structural materials. These removable forms define the bottom surface of the slab, and are in turn supported by falsework or the supporting elements for the deck slabs. Plastic concrete is placed on the removable forms, and after the concrete has attained the required strength the forms are removed, and usually reused to form other portions of the deck slab. This method of construction is labor intensive and requires the accurate construction of the forms at the required location, construction of falsework or other means of support for the forms, and subsequent removal of the forms and falsework after the concrete has reached a predetermined strength. For high bridges, removal of formwork is expensive and dangerous.

Other forming methods and methods of construction for new and replacement bridge decks have been developed and used in the past two decades. Most of these methods are described in the Transportation Research Board publication, "State of the Art: Permanent Bridge Deck Forms," Circular No. 181, September 1976, Washington, D.C.

One of those methods utilizes stay-in-place corrugated galvanized steel deck forms which are supported by the bridge beams. This type form has sufficient structural strength to transfer the weight of the fresh plastic concrete to the bridge beams. After the concrete has hardened, loads placed on the deck slab are transferred to the beams by the concrete slab. Some types of steel forms are locked into the concrete and work with the slab to resist loads applied to the slab.

Precast concrete panels have also been used to construct bridge decks. One type of panel is the full depth, precast concrete panel which is installed on the bridge beams and is the total structural element of the deck. These panels may be covered with an asphalt concrete topping to provide a smooth top surface, but the asphalt surface does not contribute to the load carrying capacity of the deck. Full depth panels have the advantage of lower installation costs and short construction time. Their disadvantages are high shipping costs and an uneven top surface due to the many required joints between the panels.

Another method used in the construction of bridge decks utilizes precast, prestressed concrete from panels which are used as the bottom form with a cast-in-place concrete topping. The cast-in-place concrete bonds to the roughened surface of the form panels and acts with the topping to produce a composite structural deck. In this type construction the panels are constructed to span between the bridge beams and are designed to act as simple beams to support their own weight and the weight of the cast-in-place concrete. After the concrete has hardened the total depth of the deck slab supports any additional loads such as the load from vehicles or additional structural components such as parapets or median divisors. An example of this form of prior art is illustrated in FIG. 1, which is a partial cross-section of a typical highway bridge. Main components shown in FIG. 1, of the accompanying drawings, are the bridge beams 1, precast, prestressed concrete form panels 2, cast-in-place topping 3, cast-in-place concrete parapet 4 and cement mortar haunch 5. The precast, prestressed concrete form panels are not continuous over the bridge beams as illustrated by the cast-in-place concrete between the ends of the panels 6. At the outside edges of the bridge 7, the form panels are usually cantilevered over the beam to support a portion of the deck slab and the cast-in-place parapet 4. Shear connectors may be welded to the tops of the bridge beams at 6 to create a composite action between the concrete deck slab and the beams. At the edge of the bridges 7, the cantilevered form panels can be provided with openings for the welded shear connectors when required.

Disadvantages of the prior form of art are that a large number of small form panels are needed. In the prefabrication of these panels, bulkheads are needed at each end of each panel. This interrupts the continuity of placing the concrete for the form panel, and becomes very labor intensive. In the construction of the bridge deck, each panel must be handled and set separately which is also very labor intensive.

The objects of this invention may be seen by referring to the below Specification and claims taken in conjunction with the accompanying drawings.

Figure 1:
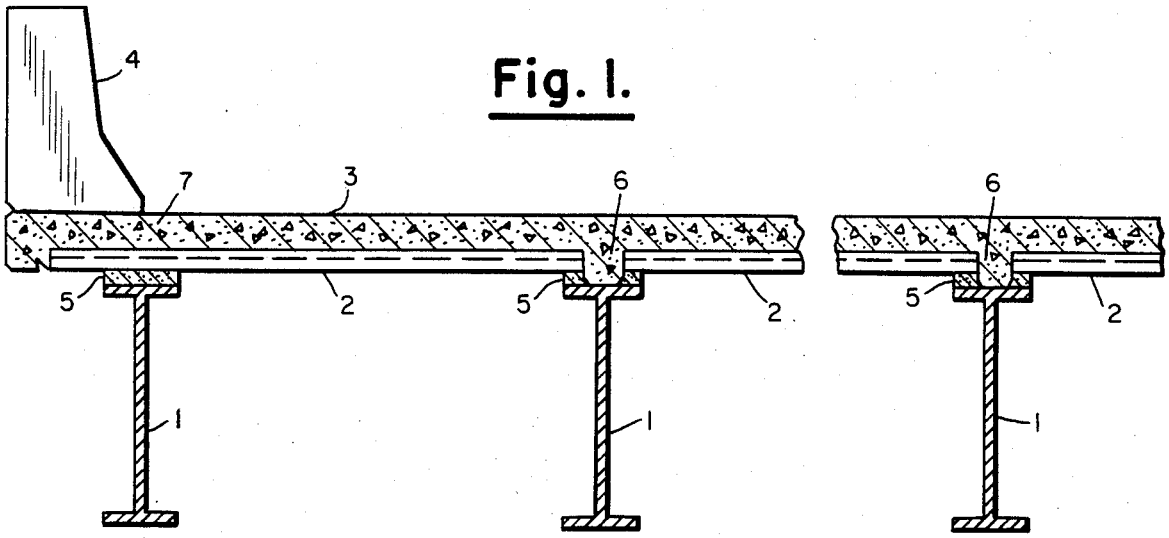
FIG. 1, is a partial cross-sectional view of a typical highway bridge utilizing the art prior to this invention.
Figure 2:
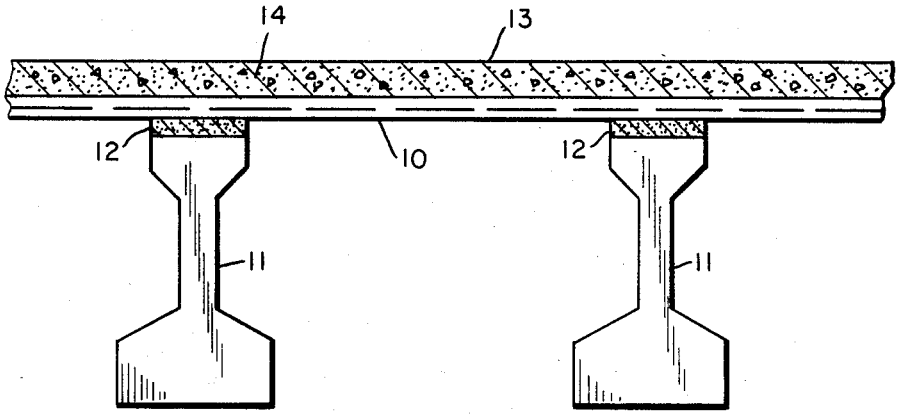
FIG. 2, is a cross-sectional view of a portion of a bridge deck illustrating the present invention.
Figure 8:
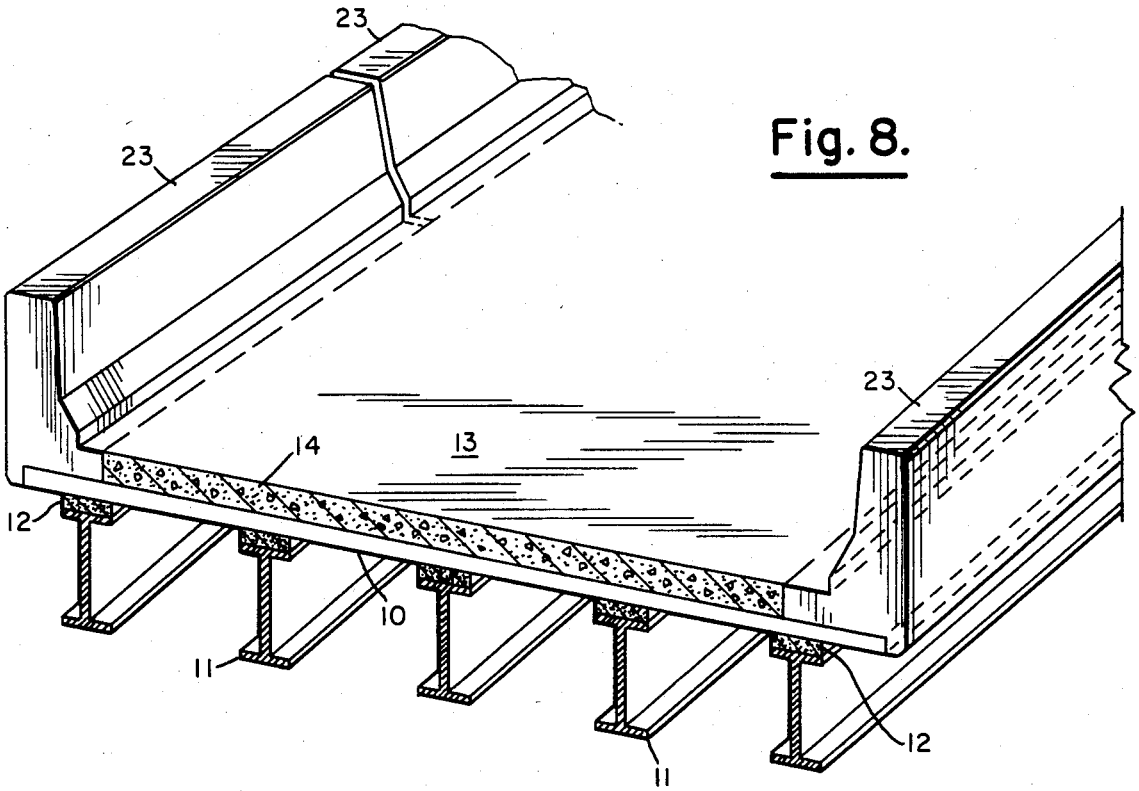
FIG. 8, is a third-dimensional view, partially in cross-section of a bridge deck and parapets utilizing the present invention.

Referring now to the drawings, and in particular to FIGS. 2 and 8, a general description of this type construction is shown. Principal components of this new method of construction are the precast, prestressed panels 10 which are continuous over the supporting beams 11. The panels 10 are set on a bed of cement mortar, epoxy mortar, other suitable material or haunch 12, placed on the top of each beam to the proper elevation so that the top surface of the panels 10 is at a uniform predetermined distance from the top of the finished deck slab 13. Reinforcing steel required for the cast-in-place concrete topping 14 is placed and supported on the top of the panels, and the cast-in-place topping 14 is then placed and finished to the proper elevation to form the completed deck slab 13.

One of the differences between this new method of constructing bridge deck slabs and the previous art form is that the precast, prestressed concrete panel forms 10 are continuous structural members over the bridge beams 11. This continuity is made possible by proper selection of the thicknesses of the prestressed panels 10 and cast-in-place topping 14, the proper selection of the magnitude of prestressing force in the prestressed panels, and the proper selection of the type and quantity of reinforcing steel in the cast-in-place topping. All of the above variables are selected so that the finished deck slab is in conformity with the appropriate specifications, building codes and current engineering practice.

The method of construction utilized in this invention begins at the point that the beams 11 of the bridge deck are set and in place. The method would involve the following steps.

(1) Set haunches 12 of the appropriate height in place on top of the bridge beams 11;

(2) Place the fabricated precast and prestressed panels 10 having a roughened top surface on top of the haunches 12 and extending in a transverse direction the entire width of the bridge;

(3) Secure the panels 10 to the haunches 12 and beams 11 with epoxy cement;

(4) Place reinforcing steel in position above the top surface of the panel;

(5) Pour concrete topping 14 on the roughened top surface of the panel to the appropriate thickness and allow the concrete to set.

It should be noted that the panels may be secured to the haunches by means of epoxy cement, shear connectors or other appropriate means.

Another difference between this present invention and the prior art form is the ability of the continuous prestressed panels to carry the loads of parapets, median divisors and median barriers prior to the placing of the cast-in-place topping.

ALTERNATE METHOD

Figure 5:
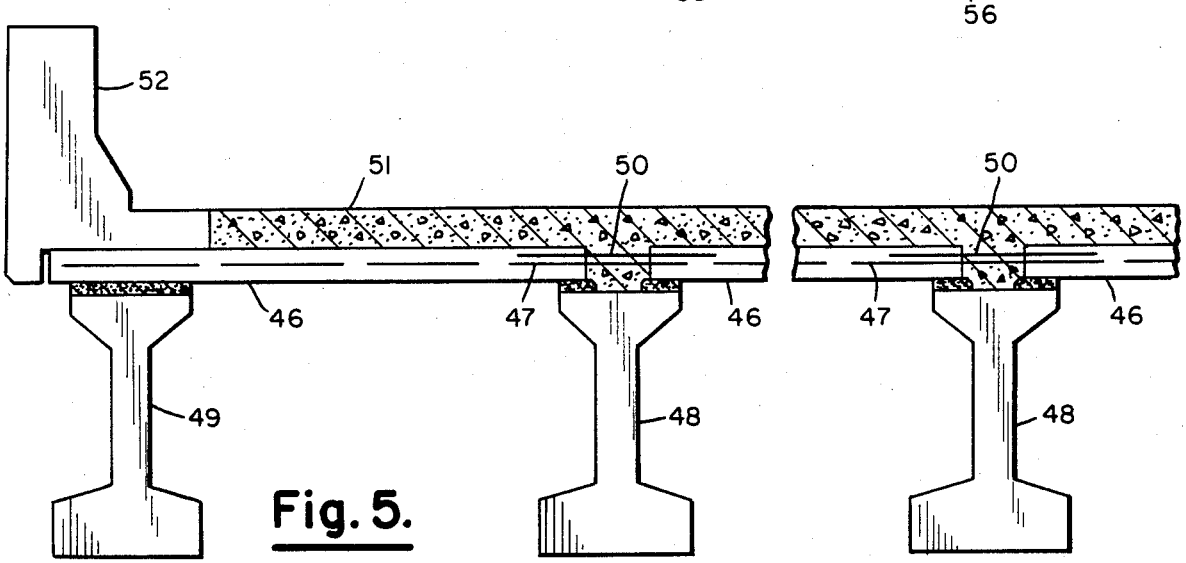
FIG. 5, is a cross-sectional view of a portion of a bridge deck and parapet or divisor, illustrating an alternate method of this invention utilized when continuous panels can not be used.

When continuous panels cannot be used on new or reconstructed bridge decks, an alternate method of this invention may be used as shown in FIG. 5. This type construction allows the precast, prestressed panels 46 to behave and be designed as simple span panels between the supporting beams 48 and 49, but the panels 46 are connected by constructing the panels 46 in such a manner that the prestressing cables 47 are continuous over the supporting beams 48. A cast-in-place concrete topping 51 is used to complete the deck system. The advantage of this method of construction is that the panels 46 may be manufactured and shipped in lengths comparable to those used in the continuous panels thus resulting in reduced manufacturing, shipping and handling costs. When necessary, steel dowels 50 may be cast into the precast, prestressed panels 46 to provide additional stiffness for handling and shipping.

This alternate method of the invention may be used with any type parapet 52 or divisor 40, and the panels 46 can support the weight of the parapets 52 or divisors 40 prior to the placement of the cast-in-place concrete 51. Another advantage of this system is that it allows access to the tops of the supporting beams 48 and 49 so that shear connectors 50 can be conveniently used to develop composite action between the beams 48 and 49 and the deck slab.

PARAPETS, SAFETY CURBS AND TRAFFIC DIVISORS

Figure 3:
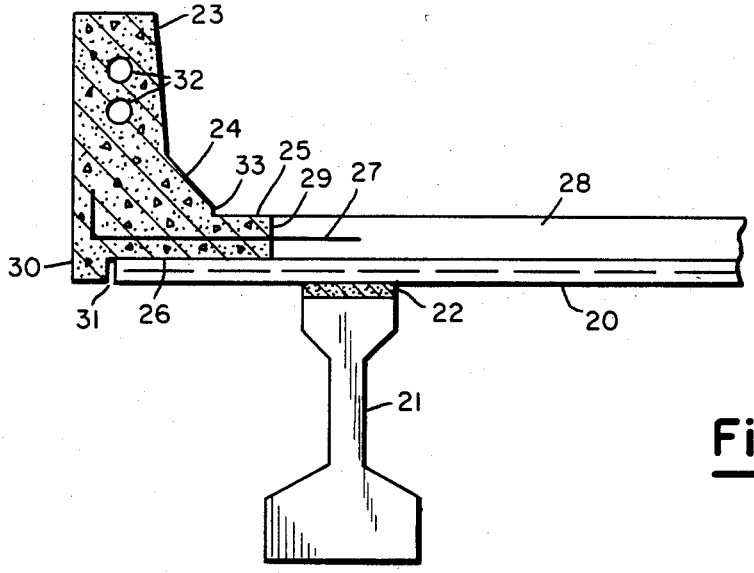
FIG. 3, is a cross-sectional view of a portion of the bridge deck, parapet and safety curb utilizing the present invention.

It is also an object of this present invention to simplify and reduce construction costs for bridge deck slabs by providing an improved method for placing and fastening precast parapets and safety curbs and traffic divisors. An illustration of this method is shown in FIG. 3, where the precast, prestressed panel form 20 is continuous over the outside or fascia beam 21. The panel is supported on a mortar bed 22 in the same manner as used on interior beams. An integral precast concrete unit consisting of a parapet 23, safety curb 24, and a portion of the top surface of the deck slab 25 is set in the proper position on the precast panels. A concrete mortar, or epoxy mortar or other suitable bonding agent 26 is used on the contact surfaces between the precast parapet units and the precast panels. Steel reinforcing dowels 27 are cast into the parapet unit and located so that they project into the cast-in-place concrete topping 28. These dowels become one of the principal structural connections between the deck slab and precast parapet. In addition, a structural connection is developed by the bonding and adhesive forces existing at the interfaces between the precast parapet unit 23 and the precast panels 20, and the precast parapet unit and the cast-in-place deck topping 28.

The bottom of the parapet unit may be provided with a projection 30 which will improve the aesthetics of the parapet 23 by covering the end of the precast, prestressed deck panels 20. This projection also creates a drip notch at the inside corner 31 which inhibits water from flowing along the bottom of the precast panel 20 and down the face of the beam 21. Other features of the precast parapet unit are voids 32 cast into the units which may be used as conduit for utilities needed for the bridge or as conduits for utilities using the bridge to cross an obstruction.

Another unique feature of this precast parapet unit 23 is the portion of the finished deck 25 which is cast as an integral part of the parapet unit 23. This portion of the unit forms the gutter line 33 and establishes the proper elevation along the edges of the cast-in-place deck slab 28. This portion of the parapet unit may be used to support and guide the equipment and machines used to place and finish the cast-in-place deck concrete 28.

MEDIAN AND DIVISOR UNITS

Figure 4:
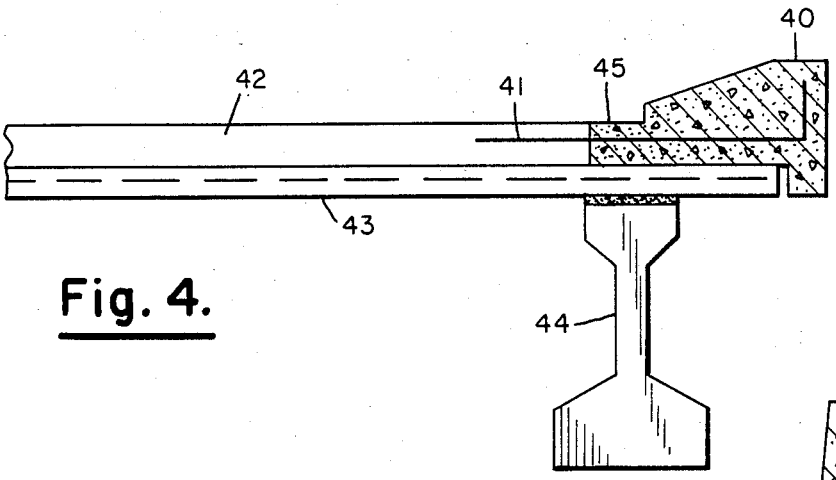
FIG. 4, is a cross-sectional view of a bridge deck and divisor median of the present invention.

The same art form used for bridge parapet units may be applied to median and divisor units used on bridge decks. An example of one configuration of divisor median is shown in FIG. 4. The median unit 40 can be prefabricated as a precast reinforced concrete element 40 in the same manner as the parapet units 23. Dowels 41 protrude from the median unit 40 into the cast-in-place deck topping 42. Both the cast-in-place deck 42 and the median 40 are supported by the precast, prestressed panel forms 43, which in turn are supported by the bridge beams 44. An integral part of the median unit is a portion of the top surface of the deck slab 45 which is used as a guide to place the cast-in-place portion of the deck 42 and to support equipment used to place and finish the cast-in-place topping 42.

ALTERNATE METHOD

Figure 6:
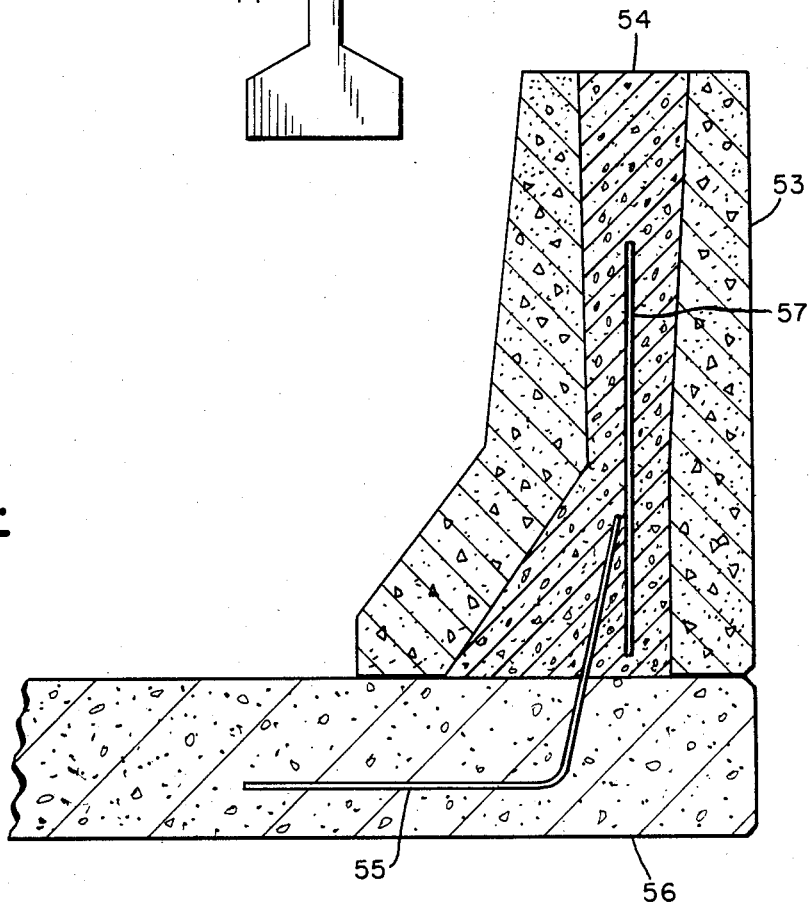
FIG. 6, is a cross-sectional view of a bridge deck and parapet illustrating an alternate method of precasting and fastening parapet divisors and median unit.
Figure 7:
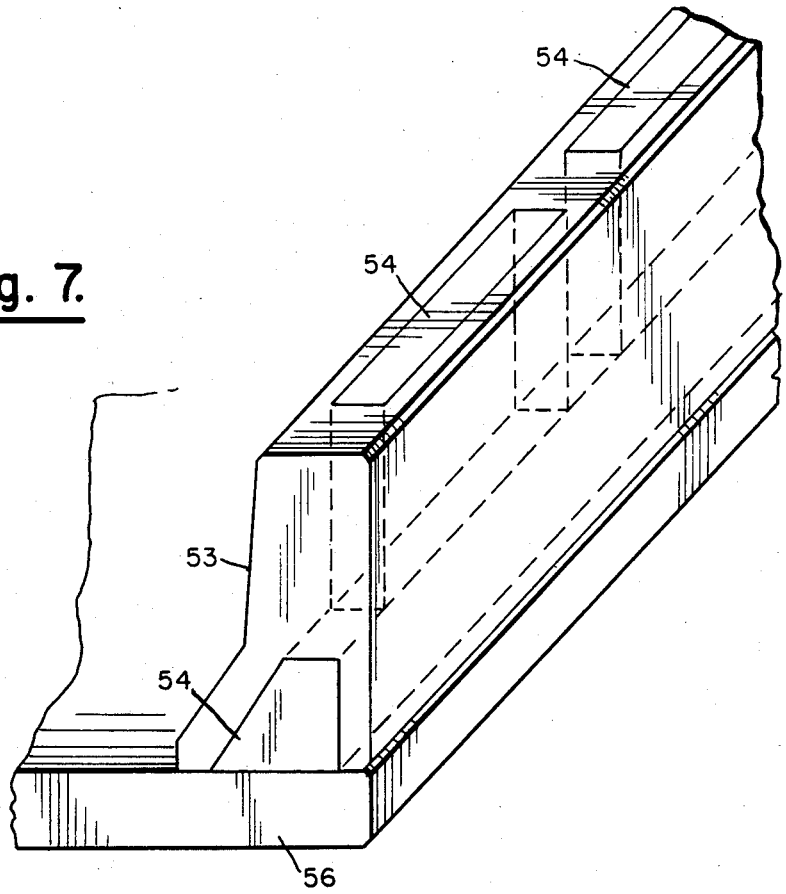
FIG. 7, is a third-dimensional view, partially in section, of a bridge deck and parapet utilizing the present invention.

An alternate method of precasting and fastening parapets divisors and median units is illustrated in FIG. 6 which is a section through a bridge deck slab and a parapet. The precast parapets 53 are made with voids 54 which are also shown in FIG. 7. Steel dowels 55 are cast into the bridge deck 56, and extend into the voids in the parapets. After the parapets are set into their proper position, additional reinforcement 57 is added and the voids 54 are filled with concrete. This type construction may be used with all types of bridge deck construction and provides parapets, medians and divisors that are comparable in strength to cast-in-place units.

The method of construction utilized is comprised of the following steps.

(1) Place reinforcing steel dowels 55 in bridge deck to extend outwardly therefrom;

(2) Place precast parapet 53 on bridge deck with reinforcing steel dowels 55 extending within void 54;

(3) Place additional reinforcement 57 in void 54 extending from the bridge deck upwardly;

(4) Fill void 54 with concrete and allow it to set.

It should be noted that conduits may be placed in void 57 prior to the pouring of the concrete therein.

I claim:

1. In a bridge structure adapted for a long span bridge, comprising in part of supporting beams extending longitudinally the length of the bridge span, said supporting beams themselves being supported by the bridge foundations, the combination comprising:

premanufactured, prefabricated and prestressed partial depth cement concrete panels positioned continuously in a general transverse direction, with a space in between each panel, over supporting beams and supported thereby, said panels comprising:

a plurality of prestressing cables extending within and through said panels in a general perpendicular direction to said supporting bridge beams;

said prestressing cables extending continuously through each panel, through the space in between and through the adjacent panel;

said prestressing cables extending continuously through said panels in an approximate perpendicular direction to the direction of the said supporting beams;

a roughened top surface of said concrete panel to permit bonding;

a cast-in-place cement concrete topping placed on the top surface of said concrete panel to form a smooth continuous top surface thereon, said concrete topping bonded to said concrete roughened top surface panel which when hardened forms a portion of the structural system in conjunction with said panel and bears loads impinging upon said cement concrete topping;

reinforcing members placed within said cement concrete topping, said topping adapted to bond with said panel and in combination therewith act as a structural member;

a shear connecting dowel connecting each of said adjacent panels and extending across the space in between;

haunches positioned between said panel and said beam, said haunches being of appropriate height to position the top surface of said panel.

2. In a bridge structure adapted for a long span bridge, comprising in part of supporting beams extending longitudinally the length of the bridge span, said supporting beams themselves being supported by the bridge foundations, the combination comprising:

premanufactured, prefabricated and prestressed partial depth cement concrete panels positioned continuously in a general transverse direction, with a space in between each panel, over supporting beams and supported thereby, said panels comprising:

a plurality of prestressing cables extending within and through said panels in a general perpendicular direction to said supporting bridge beams;

said prestressing cables extending continuously through each panel, through the space in between and through one adjacent panel;

said prestressing cables extending continuously through said panels in an approximate perpendicular direction to the direction of the said supporting beams;

a roughened top surface of said concrete panel to permit bonding;

a cast-in-place cement concrete topping placed on the top surface of said concrete panel to form a smooth continuous top surface thereon, said concrete topping bonded to said concrete roughened top surface panel which when hardened forms a portion of the structural system in conjunction with said panel and bears loads impinging upon said cement concrete topping;

a single unit precast parapet placed upon said prefabricated prestressed cement concrete panel adjacent to which is poured said cast-in-place concrete topping, comprising in combination:

a single unit parapet body;

a coupling rod member extending from within said parapet body into said cast-in-place concrete topping;

a generally horizontal guide-support slab as an integral part of said parapet body adapted to support equipment used to pour and finish said cast-in-place topping to the appropriate thickness;

haunches positioned between said panel and said beam, said haunches being of appropriate height to position the top surface of said panel.

3. In a bridge structure adapted for a long span bridge, comprising in part of supporting beams extending longitudinally the length of the bridge span, said supporting beams themselves being supported by the bridge foundations, the combination comprising:

premanufactured, prefabricated and prestressed partial depth cement concrete panels positioned continuously in a general transverse direction, with a space in between each panel, over supporting beams and supported thereby, said panels comprising:

a plurality of prestressing cables extending within and through said panels in a general perpendicular direction to said supporting bridge beams;

said prestressing cables extending continuously through each panel, through the space in between and through the adjacent panel;

said prestressing cables extending continuously through said panels in an approximate perpendicular direction to the direction of the said supporting beams;

a roughened top surface of said concrete panel to permit bonding;

a cast-in-place cement concrete topping placed on the top surface of said concrete panel to form a smooth continuous top surface thereon, said concrete topping bonded to said concrete roughened top surface panel which when hardened forms a portion of the structural system in conjunction with said panel and bears loads impinging upon said cement concrete topping;

a parapet positioned on one of said panels, comprising in combination:

a parapet body being a structural member and having a longitudinal void extending through the bottom portion thereof, said longitudinal void in communication with more than one generally vertical concrete pouring void segments extending through the top of said parapet body;

dividing members being an integral part of the structural parapet and extending substantially the height of said parapet body from the top of said parapet body to said longitudinal void and adapted to strengthen said parapet body;

a coupling dowel extending from said cast-in-place cement concrete topping to within said longitudinal void;

a reinforcing member extending through said longitudinal void into said pouring void;

haunches positioned between said panel and said beam, said haunches being of appropriate height to position the top surface of said panel.

4. In a bridge structure adapted for a long span bridge, comprising in part of supporting beams extending longitudinally the length of the bridge span, said supporting beams themselves being supported by the bridge foundations, the combination comprising:

premanufactured, prefabricated and prestressed partial depth cement concrete panels positioned continuously in a general transverse direction, with a space in between each panel, over supporting beams and supported thereby, said panels comprising:

a plurality of prestressing cables extending within and through said panels in a general perpendicular direction to said supporting bridge beams;

said prestressing cables extending continuously through the space between adjacent panels;

said prestressing cables extending continuously through said panels in an approximate perpendicular direction to the direction of the said supporting beams;

a roughened top surface of said concrete panel to permit bonding;

a cast-in-place cement concrete topping placed on the surface of said concrete panel in the space between and upon said prestressing cables to form a smooth continuous top surface thereon, said concrete topping bonded to said concrete roughened top surface panel which when hardened forms a portion of the structural system in conjunction with said panel and bears loads impinging upon said cement concrete topping;

haunches positioned between said panel and said beam, said haunches being of appropriate height to position the top surface of said panel;

whereby said cement concrete panels, cast-in-place cement concrete topping and prestressing cables function as a structurally continuous unit having continuous beam action and structural interaction between all spans.

5. The combination as claimed in claim 4, having reinforcing members placed within said cement concrete topping, said topping adapted to bond with said panel and in combination therewith act as a structural member.

* * * * *